US008227968B2

(12) United States Patent
Kaandorp et al.

(10) Patent No.: US 8,227,968 B2
(45) Date of Patent: Jul. 24, 2012

(54) LAMP ASSEMBLY

(75) Inventors: Wouter Petrus Kaandorp, Best (NL); Harald Josef Gunther Radermacher, Aachen (DE); Erik Boonekamp, Utrecht (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/379,052

(22) PCT Filed: Jun. 14, 2010

(86) PCT No.: PCT/IB2010/052630

§ 371 (c)(1),
(2), (4) Date: Dec. 19, 2011

(87) PCT Pub. No.: WO2010/146518

PCT Pub. Date: Dec. 23, 2010

(65) Prior Publication Data

US 2012/0098404 A1 Apr. 26, 2012

(30) Foreign Application Priority Data

Jun. 19, 2009 (EP) ..... 09163193

(51) Int. Cl.
*F21K 7/00* (2006.01)

(52) U.S. Cl. ..... 313/114; 313/498; 362/296.01; 362/341; 362/514

(58) Field of Classification Search ..... None
See application file for complete search history.

(56) References Cited

U.S. PATENT DOCUMENTS

| | | | | |
|---|---|---|---|---|
| 5,105,347 | A * | 4/1992 | Ruud et al. | 362/268 |
| 2009/0097258 | A1 | 4/2009 | Tseng et al. | |
| 2009/0141474 | A1 * | 6/2009 | Kolodin | 362/84 |
| 2009/0196043 | A1 * | 8/2009 | Calmes | 362/278 |
| 2010/0046234 | A1 * | 2/2010 | Abu-Ageel | 362/308 |

FOREIGN PATENT DOCUMENTS

| | | | |
|---|---|---|---|
| CN | 101275731 | A | 10/2008 |
| DE | 202005019594 | U1 | 3/2006 |
| DE | 202006014239 | U1 | 1/2007 |
| TW | 48655700 | A | 5/2002 |
| WO | 2006125395 | A1 | 11/2006 |
| WO | 2008149250 | A1 | 12/2008 |

* cited by examiner

*Primary Examiner* — Ashok Patel
(74) *Attorney, Agent, or Firm* — Mark L. Beloborodov

(57) ABSTRACT

A lamp assembly (1) comprises at least a light source (8) and a reflector for reflecting light from the light source (8). The reflector is positionable with respect to the light source (8) in at least a first position and a second position to obtain a spot-like light emission in the first position and a more or less omnidirectional light emission, in the second position, of the light emitted by the lamp assembly (1). The lamp assembly (1) comprises a reflective layer (7). In the first position of the reflector at least part of the light is reflected by the reflector as well as by the reflective layer (7). In the second position of the reflector at least part of the light is reflected by the reflector and passes along the reflective layer (7).

12 Claims, 5 Drawing Sheets

LAMP ASSEMBLY

FIELD OF THE INVENTION

The invention relates to a lamp assembly comprising at least a light source and a reflector for reflecting light from the light source.

BACKGROUND OF THE INVENTION

In such a lamp assembly, which is known from WO 2005/024898 A2, the light source is a LED. Part of the light from the light source is directly emitted in forward directions, whilst the other part of the light from the light source is reflected in forward directions by the reflector. By using such a lamp assembly, a spot-like light emission is obtained. While in some applications such directed light is useful, in other applications the spot-like emission is highly undesirable. These applications require a GLS-like light distribution. However, since LEDs emit only in a half sphere, a GLS-like light distribution with a more or less omnidirectional light emission cannot be obtained with the known lamp assembly.

SUMMARY OF THE INVENTION

It is an object of the invention to provide a lamp assembly of which the direction of light emission is adjustable.

This object is accomplished with the lamp assembly according to the invention in that the reflector is positionable with respect to the light source in at least a first position, being essentially a half-sphere at the most, and a second position, to obtain light emission in the first position and a more or less omnidirectional light emission in the second position of the light emitted by the lamp assembly.

Due to the different possible positions of the reflector, different light emissions are obtained. In the first position of the reflector, a spot-like emission is obtained in directions that all fall within a half-sphere with an apex angle of 180°, for example such that all the light is directed in forward directions only, for example as a wide beam with an apex angle of the beam of for example 100°, or as a narrow beam with an apex angle of the beam of for example 40°, or as a spot-light emission with an apex angle of the beam of for example 15°. In the second position of the reflector a more or less omnidirectional emission is obtained such that the light is directed in forward directions as well as in backward directions opposite to the forward directions.

An embodiment of the lamp assembly according to the invention is characterized in that the lamp assembly comprises a reflective layer, wherein in the first position of the reflector at least part of the light is reflected by the reflector as well as by the reflective layer, whereas in the second position of the reflector at least part of the light is reflected by the reflector and passes along the reflective layer.

Due to the reflective layer, light reflected by the reflector will be reflected by the reflective layer as well in the first position of the reflector. In this position part of the light will pass the reflector and be directly emitted in forward direction. The part of the light reflected by the reflector will be reflected by the reflective layer and also be emitted in forward direction.

In the second position of the reflector, part of the light will pass the reflector and be directly emitted in forward direction. The part of the light reflected by the reflector will pass along the reflective layer and be emitted in backward direction.

Another embodiment of the lamp assembly according to the invention is characterized in that the light source is located near a central axis of the light assembly, which light assembly further comprises a base element provided with a number of openings positioned around the central axis, wherein the reflector comprises a number of reflector segments positioned around the central axis, which reflector is located at a distance from the base element, wherein in the first position of the reflector with respect to the base element light from the light source and reflected by the reflector segments is directed onto the base element whilst in the second position of the reflector with respect to the base element light from the light source and reflected by the reflector segments is directed through the openings in the base element.

In the first position, part of the light is directed directly from the base element in forward directions whilst the other part of the light is reflected by the reflector segments towards the base element. In this first position a spot-like light emission will be obtained.

In the second position also part of the light is directed directly in forward directions. The other part of the light is reflected by the reflector segments towards the openings in the base element and will be redirected in backward directions opposite to the forward directions. In the second position a more or less omnidirectional light emission similar to that of a traditional GLS-bulb will be obtained.

It is possible to select the desired position of the reflector with respect to the base element only once, after which the reflector and base element are fixed to each other, or to make the reflector and the base element adjustable to each other so that at each moment the lamp assembly can be adjusted to the desired kind of light distribution.

Yet another embodiment of the lamp assembly according to the invention is characterized in that the base element comprises the reflective layer, wherein in the first position of the reflector with respect to the base element, light directed onto the base element is reflected by the base element.

The base element can easily be provided with the reflective layer. Due to the reflective layer, the light reflected by the reflector elements towards the base element will be reflected by the base element in forward directions.

A further embodiment of the lamp assembly according to the invention is characterized in that the reflector is rotatable with respect to the base element at least from the first position to the second position and vice versa.

In this manner the orientation of the lamp assembly can be adjusted during operation by the user. It is also possible to rotate the reflector with respect to the base element to an intermediate position between the first and second position. In the intermediate position, light reflected by the reflector segments is partly directed onto the base element and partly directed through the openings in the base element, causing the emission to be partly spot-like and partly omnidirectional.

Another embodiment of the lamp assembly according to the invention is characterized in that in each position the reflector is lockable with respect to the base element.

A person who wants to move the reflector with respect to the base to another position must first unlock the reflector for example by moving the reflector against a certain spring force. At the desired other position the reflector will be locked in said position for example by means of a spring force.

Yet a further embodiment of the lamp assembly according to the invention is characterized in that in the second position of the reflector, the reflector segments of the reflector are aligned with the openings in the base element.

In this manner it is ensured that all light reflected by the reflector elements will be directed through the openings in the base element.

Another further embodiment of the lamp assembly according to the invention is characterized in that the reflector is mounted in a transparent envelope.

Due to the transparent envelope the lamp assembly will look like a GLS-lamp. Such kind of lamps with a LED as light source are called LED retrofit lamps, especially if the lamp assembly comprises a socket similar to GLS-lamps. Since the lamp assembly according to the invention can be used with a GLS-like emission pattern, the lamp assembly according to the invention is suitable as replacement for a GLS-lamp with an omnidirectional light distribution.

A further embodiment of the lamp assembly according to the invention is characterized in that the transparent envelope is mounted onto the base element by means of retention springs.

Due to the retention springs the transparent envelope is easily rotatable with respect to the base element.

Another embodiment of the lamp assembly according to the invention is characterized in that the reflector is mounted on a transparent plate extending parallel to the reflective layer.

Such a transparent plate with reflector segments can be easily manufactured.

A further embodiment of the lamp assembly according to the invention is characterized in that the light source is mounted on the base element.

The light source, for example a LED or laser, can easily be mounted on the base element, causing the light emitted in a half sphere by the LED to be directed so as to extend over the base element and, in forward directions, away from the base element.

An embodiment of the lamp assembly according to the invention is characterized in that the base element is a heat sink.

In this manner, the base element supporting the light source will dissipate the heat of the light source.

BRIEF DESCRIPTION OF THE DRAWINGS

The invention will be explained in more detail with reference to the drawing, in which.

DETAILED DESCRIPTION OF EMBODIMENTS

In the Figures, like parts are indicated by the same numerals.

Figure 1:
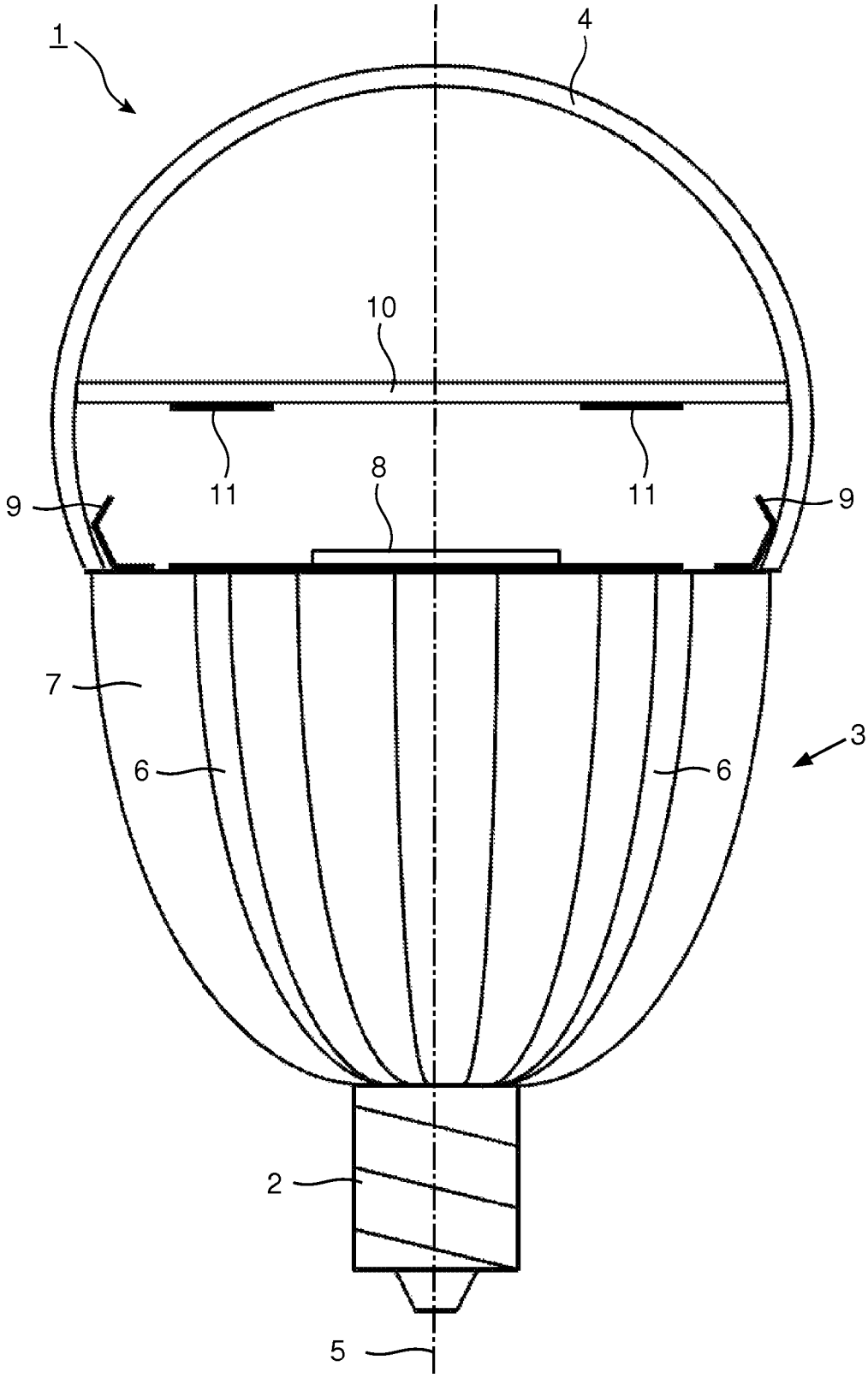
FIG. 1 is a side view of a lamp assembly according to the invention.
Figure 2:
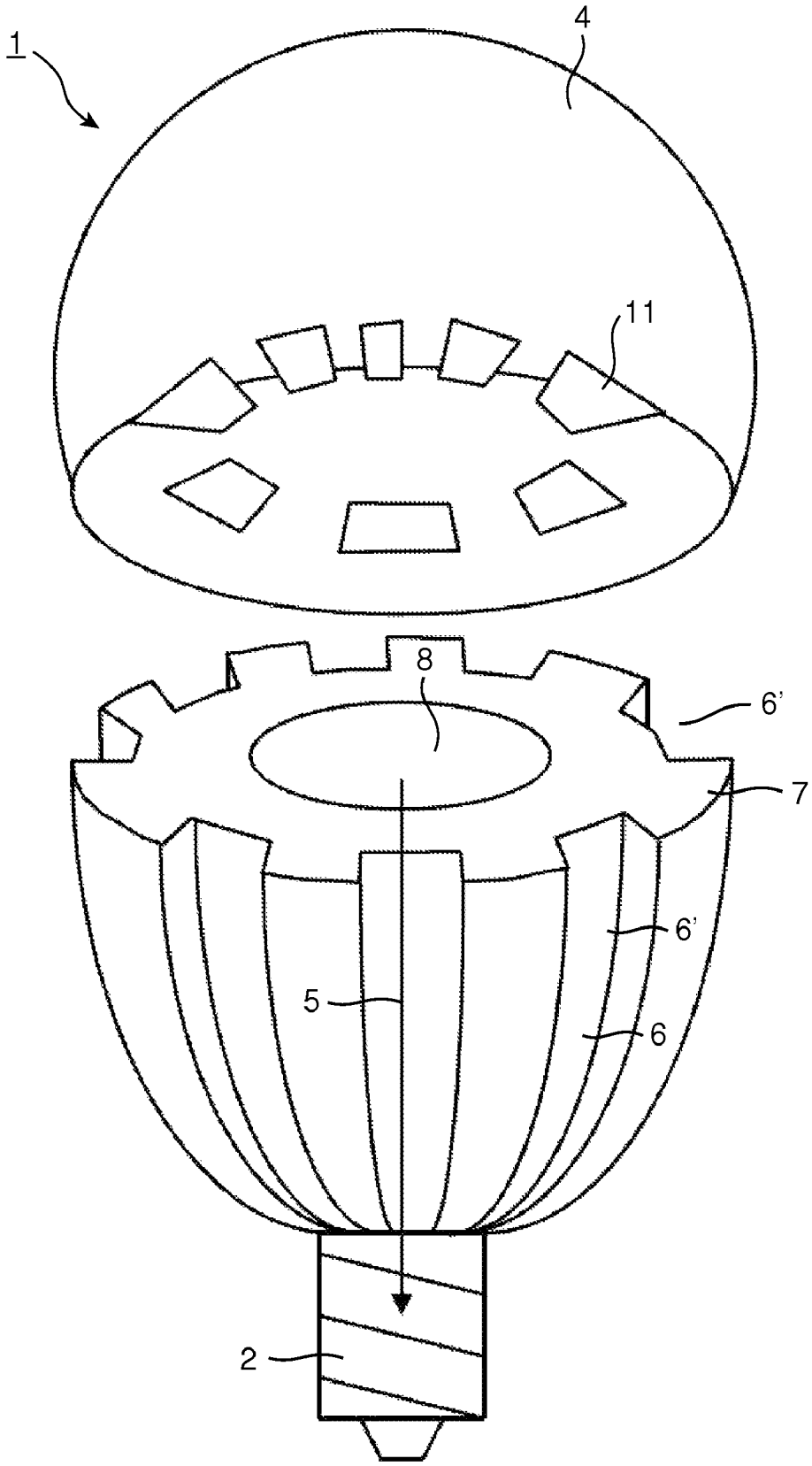
FIG. 2 is an exploded perspective view of the lamp assembly as shown in FIG. 1.

FIGS. 1 and 2 show a side view and an exploded perspective view, respectively, of a lamp assembly 1 according to the invention. The lamp assembly 1 comprises a socket 2, a base element 3 and a transparent bulb-shaped envelope 4. The socket 2 is compatible with the socket of a common GLS-lamp, for example an E27 screw socket. The base element 3 is made of a material with a good thermal conductivity, like metal. The base element 3 has a frustoconical shape with a central axis 5. The outer side of the base element 3 is provided with longitudinal slits 6 extending from the socket 2 to a reflective layer 7 provided on the base element 3 at a side remote from the socket 2. The slits 6 form openings 6' in the circumference of the reflective layer 7.

In the centre of the reflective layer 7 of the base element 3 a light source, for example a LED 8 is located. The electronic circuit of the LED 8 is located inside the base element 3. The LED 8 is in thermal contact with the base element 3, which functions as a heat sink to dissipate heat away from the LED, especially due to the slits 6. The slits 6 increase the contact area towards the ambient cooling medium, for example air. Retention springs 9 are located at the circumference of the reflective layer 7 at positions between the slits 6. The retention springs 9 press against the inside of the bulb-shaped envelope 4. Due to the shape of the retention springs 9, the bulb-shaped envelope 4 is pulled in the direction of the base element 3. The bulb-shaped envelope 4 is rotatable with respect to the base element 3 about the central axis 5 by sliding along the retention springs 9. The bulb-shaped envelope 4 is provided with a transparent plate 10 on which a number of reflector segments 11 are located. The reflector segments 11 are arranged in a circle around the central axis 5 and are spaced from each other. The reflector segments 11 form a reflector. The transparent plate 10 extends parallel to the reflective layer 7 of the base element 3 and is located at a distance from said reflective layer. The number of reflector segments 11 is the same as the number of slits 6 in the base element 3.

Figure 3:
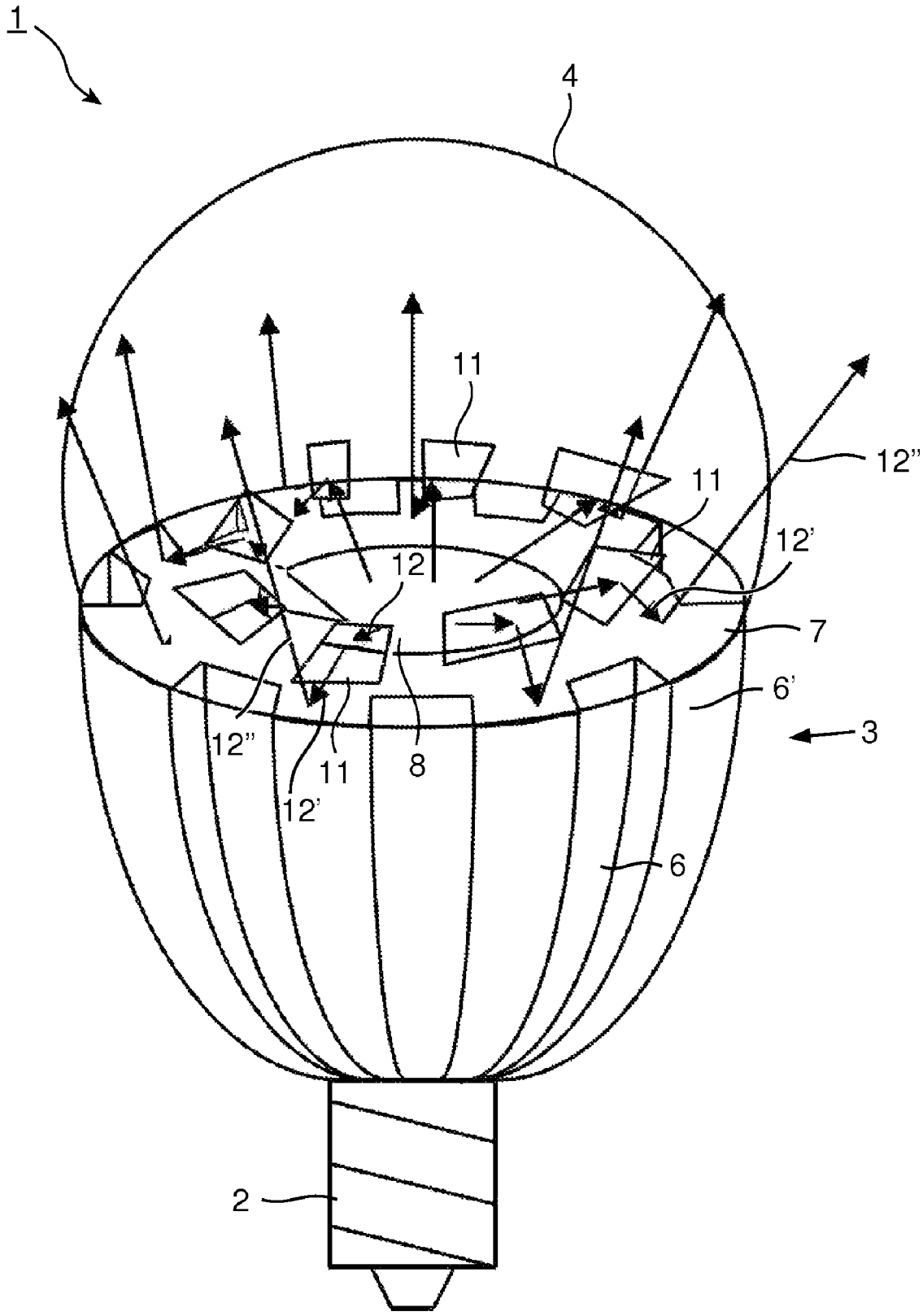
FIG. 3 is a perspective view of the lamp assembly as shown in FIG. 1, with the reflector in the first position with respect to the base element.

In FIG. 3 the lamp assembly 1 is shown in a first position of the reflector with respect to the base element 3, wherein the reflector segments 11 are situated above the reflective layer 7 between the openings 6' formed by the slits 6. When the LED 8 is activated, a number of light beams are directed in forward directions, i.e. directions away from the socket 2 and the base element 3. These light beams will pass the reflector segments 11 and will go through the transparent plate 10 and the transparent envelope 4. Those light beams are not shown in FIGS. 3-5.

Other light beams 12 will be directed by the LED 8 towards the reflector segments 11, are reflected by the reflector segments 11 as light beams 12' towards the reflective layer 7 and are then reflected by the reflective layer 7 as light beams 12" in forward directions. The dimensions of the reflector segments 11 and the openings 6' formed by the slits 6 as well as the orientation of the reflector segments 11 with respect to the openings 6' formed by the slits 6 are preferably such that no light beam of the LED 8 will be reflected by the reflector segments 11 into the openings 6' formed by the slits 6. All light beams of the LED 8 are directed in forward directions. The lamp assembly 1 with the reflector in the first position with respect to the base element 3 generates a spot-like light emission.

Figure 4:
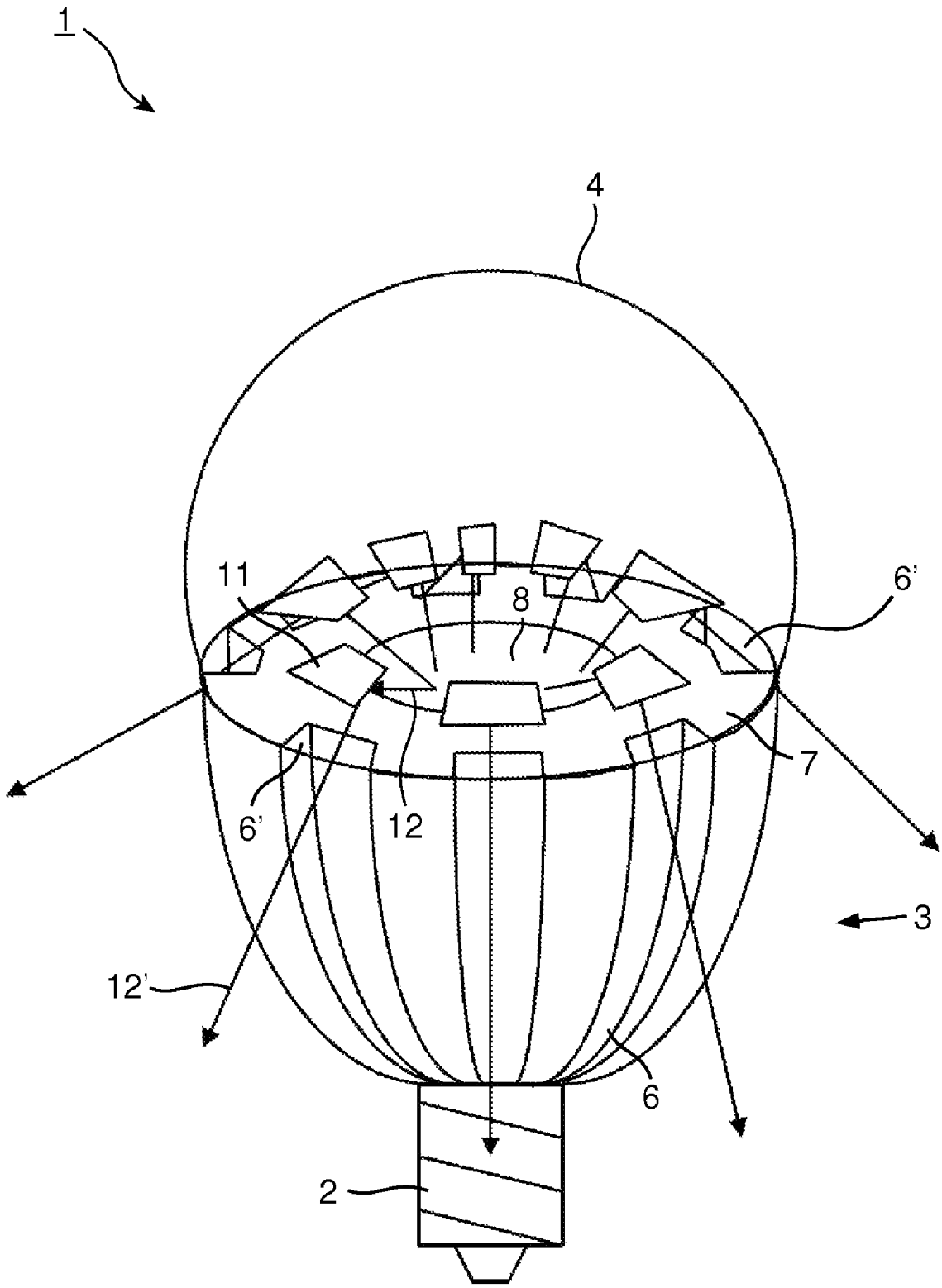
FIG. 4 is a perspective view of the lamp assembly as shown in FIG. 1, with the reflector in the second position with respect to the base element.
Figure 5:
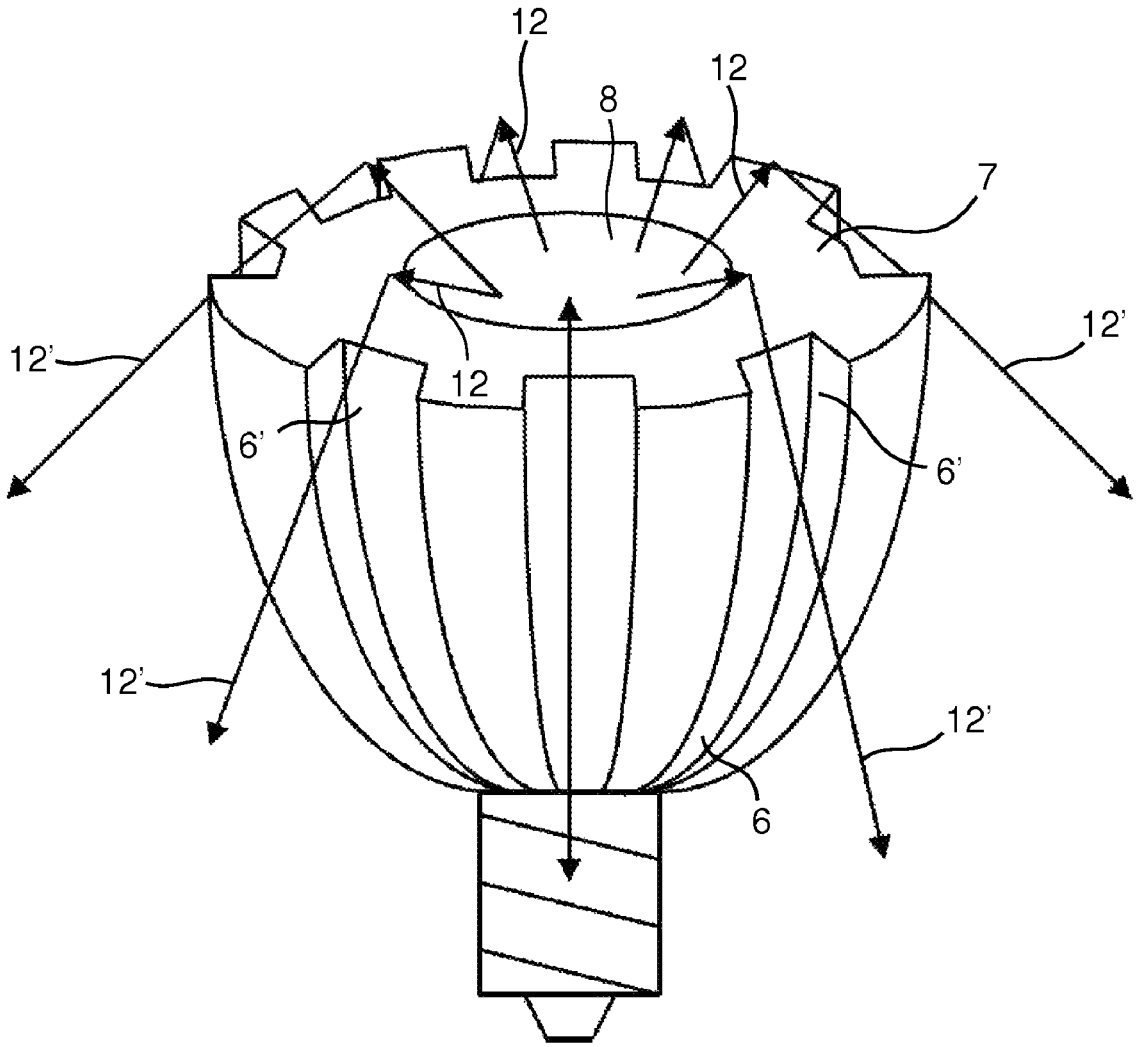
FIG. 5 is a perspective view of the base element of the lamp assembly as shown in FIG. 4, with a light beam reflected by the reflector segments (not shown in FIG. 5) and passing through openings in the base element.

In FIGS. 4 and 5 the lamp assembly 1 is shown in a second position of the reflector with respect to the base element 3, wherein the reflector segments 11 are situated above the openings 6' formed by the slits 6. As already indicated above, the light beams from the LED 8 which will pass the reflector segments 11 are all directed directly in forward directions. Those light beams are not shown.

The light beams 12 which are directed by the LED 8 towards the reflector segments 11, will be reflected by the reflector segments 11 as light beams 12' towards the base element 3 and will pass through openings 6' formed by the slits 6 in the base element 3 in backward directions opposite to the forward directions. The light beams of the LED 8 will be directed both in forward and backward directions, so that a GLS-like light distribution is realised. The lamp assembly 1 with the reflector in the second position with respect to the base element 3 generates a more or less omnidirectional light emission.

If desired, the reflector can be positioned in an intermediate position between the first and second position, whereby half of the light reflected by the reflector segments 11 is directed towards the reflective layer 7 and reflected in forward directions, whilst the other half of the light reflected by the reflector segments 11 will pass through openings 6' formed by the slits 6 in the base element 3 in backward directions. Also other intermediate positions are possible, wherein the user can adjust the reflector with respect to the base element 3 to a position where the desired combination of spot-like light emission and omnidirectional light emission is obtained.

It is also possible that the reflector is only adjusted with respect to the base element 3 during the manufacturing process and that the reflector and base element 3 are then fixed to each other.

The reflector segments 11 can also be mounted directly on the inner side of the bulb-shaped envelope 4.

It is also possible to use another kind of envelope 4 or other means for mounting the reflector segments 11 at a distance from the reflective layer 7.

It is also possible that the base element 3 is not provided with a reflective layer 7.

It is possible to provide the lamp assembly 1 with locking means like protrusions to be locked into engagement with notches under a spring force, to lock the reflector in the first, second and if desired other predetermined positions so that the setting of a desired emission characteristic can easily be done.

It is also possible to use more LEDs or to position the openings 6' and the reflector segments 11 in another orientation with respect to each other, for example an ellipse instead of a circle.

Additional light shaping options are possible when the movable reflector segments 11 and the reflective layer 7 are not flat but curved. When curved, the reflector segments 11 and reflective layer 7 may act like a lens.

The electronic circuit of the LED can also be located outside the base element.

The light source can also comprise a laser, an ACLED or a high voltage DCLED.

It is also possible to choose between diffuse and specular reflection materials, for example to use a specular reflector material for the reflecting elements 11 and a diffuse reflective layer 7.

It is also possible to have a ring-shaped light source, like a ring of LEDs 8, whilst the centre is covered with a reflective layer. Alternatively, mounting means for the rotatable reflecting elements 11 can be positioned there.

The invention claimed is:

1. Lamp assembly comprising a light source and a reflector for reflecting light from the light source, wherein the reflector is positionable with respect to the light source in at least a first position and a second position to obtain light emission substantially in a half-sphere at the most in the first position and a substantially omnidirectional light emission in the second position of the light emitted by the lamp assembly.

2. Lamp assembly according to claim 1, wherein the lamp assembly comprises a reflective layer, wherein in the first position of the reflector at least part of the light is reflected by the reflector as well as by the reflective layer , whereas in the second position of the reflector at least part of the light is reflected by the reflector and passes along the reflective layer.

3. Lamp assembly according to claim 1, wherein the light source is located near a central axis of the light assembly, which light assembly further comprises a base element provided with a number of openings positioned around the central axis, wherein the reflector comprises a number of reflector segments positioned around the central axis , which reflector is located at a distance from the base element , wherein in the first position of the reflector with respect to the base element light from the light source and reflected by the reflector segments is directed onto the base element whilst in the second position of the reflector with respect to the base element light from the light source and reflected by the reflector segments is directed through the openings in the base element.

4. Lamp assembly according to claim 2, wherein the base element comprises the reflective layer, wherein in the first position of the reflector with respect to the base element light directed onto the base element is reflected by the base element.

5. Lamp assembly according to claim 3, wherein the reflector is rotatable about the central axis with respect to the base element at least from the first position to the second position and vice versa.

6. Lamp assembly according to claim 5, wherein in each position the reflector is lockable with respect to the base element.

7. Lamp assembly according to claim 2, wherein in the second position of the reflector, the reflector segments of the reflector are aligned with the openings in the base element.

8. Lamp assembly according to claim 1, wherein the reflector is mounted in a transparent envelope.

9. Lamp assembly according to claim 3, wherein the transparent envelope is mounted onto the base element by means of retention springs.

10. Lamp assembly according to claim 2, wherein the reflector is mounted on a transparent plate extending parallel to the reflective layer.

11. Lamp assembly according to claim 3, wherein the light source is mounted on the base element.

12. Lamp assembly according to claim 3, wherein the base element is a heat sink.

* * * * *